US005255453A

United States Patent [19]

Weiss

[11] Patent Number: 5,255,453

[45] Date of Patent: Oct. 26, 1993

[54] FOOTBALL SHOE AND METHOD THEREFOR

[76] Inventor: Harry M. Weiss, 6611 N. Central Ave., Phoenix, Ariz. 85012

[21] Appl. No.: 473,610

[22] Filed: Feb. 1, 1990

[51] Int. Cl.[5] ..... A43C 15/00

[52] U.S. Cl. ..... 36/134; 36/128; 36/67 D

[58] Field of Search ..... 36/134, 59 A, 59 R, 36/61, 62, 67 R, 67 D, 128

[56] References Cited

U.S. PATENT DOCUMENTS

| | | | |
|---|---|---|---|
| 1,344,972 | 6/1920 | Armour | 36/59 A |
| 1,493,856 | 5/1924 | Golden | 36/134 |
| 2,378,028 | 6/1945 | Nimrick | 36/59 A |
| 2,740,208 | 4/1956 | Dye | 36/59 R |
| 3,561,140 | 2/1971 | Ludwig | 36/59 R |
| 3,638,337 | 2/1972 | Dollar, Jr. | 36/67 R |

FOREIGN PATENT DOCUMENTS

| | | | |
|---|---|---|---|
| 703539 | 5/1931 | France | 36/59 A |

*Primary Examiner*—Steven N. Meyers
*Attorney, Agent, or Firm*—Harry M. Weiss

[57] ABSTRACT

A football shoe for use in preventing leg injuries is provided. This shoe includes a vertical portion preferably having eyelets for a shoelace, a sole having a lower surface and a heel portion, and a plurality of cleats. Each cleat having or using a break-away means for breaking the cleat away from the sole of the shoe such as by using either a break-away portion or an adhesive layer on the top portion of each cleat which is bonded to the sole's lower surface that is used to hold each cleat on the sole of the shoe. Both the adhesive layer and the break-away portion or piece have a preselected failure shear force the occurrence of which causes a separation of each cleat from the sole thereby avoiding leg injuries.

10 Claims, 1 Drawing Sheet

FOOTBALL SHOE AND METHOD THEREFOR

BACKGROUND ON THE INVENTION

1. Field of Invention

The invention generally relates to a football shoe and method therefor, and in particular the invention relates to a football shoe and method therefor having break-away cleats.

2. Description of the Prior Art

The prior art football shoe includes a vertical portion, a sole, and a plurality of cleats, that are fixedly connected to the sole.

One problem with the prior art football shoe is that a leg injury is sometimes caused by a torque applied to a leg of a wearer because the cleats prevent the shoe from turning.

SUMMARY OF THE INVENTION

According to the present invention, a football shoe and method therefor is provided. This shoe preferably comprises a vertical (foot or ankle support) portion, a sole, and a plurality of cleats attached to the bottom surface of the sole. In one embodiment, each cleat has an adhesive layer that is fixedly connected to both the cleat and to the sole. By using the adhesive layer that is fixedly connected to both the cleat and to the sole, the problem of leg injuries is minimized because the cleat will break away from the sole when the cleat is subjected to a shear force equal to or above a preselected value.

In another embodiment, each cleat is attached to the bottom of the sole by means of a break-away (non-adhesive) portion so that each cleat so connected to the sole can be broken-away when subjected to a torque or shear force above a pre-selected minimum value below which each cleat would function in a normal useable manner.

The foregoing and other objects, features and advantages will be apparent from the following description of the preferred embodiment of the invention as illustrated in the accompanying drawings.

DESCRIPTION OF THE PREFERRED EMBODIMENT

Figure 1:
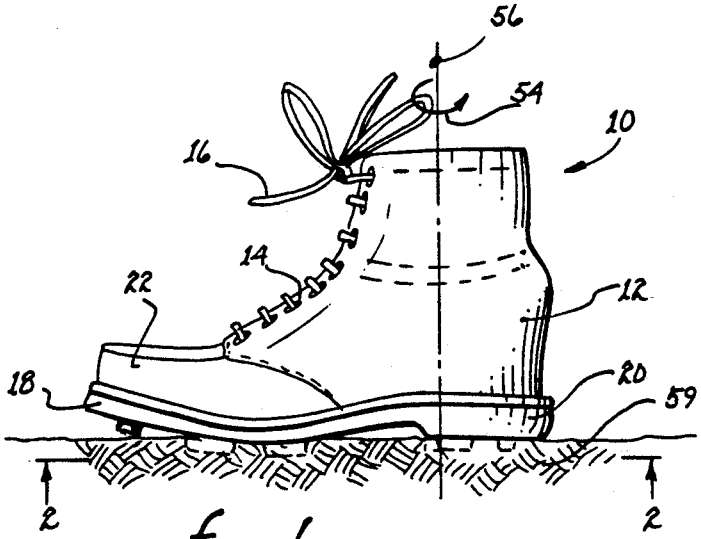
FIG. 1 is an elevation view of a football shoe according to the present invention.

As shown in FIG. 1, a football shoe 10 is provided. Shoe 10, which is a left shoe, has a vertical (foot and/or ankle support) portion 12 having a plurality of eyelets 14 for a shoelace 16. Shoe 10 also has a sole 18, which has a heel portion 20. Shoe 10 also has a top portion 22.

Figure 2:
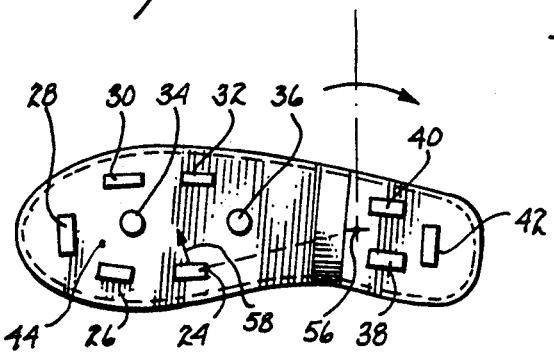
FIG. 2 a bottom view taken along the 2—2 of FIG. 1.
Figure 4:
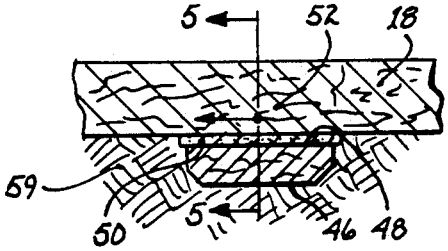
FIG. 4 is a section view taken along the line 4—4 of FIG. 3.
Figure 5:
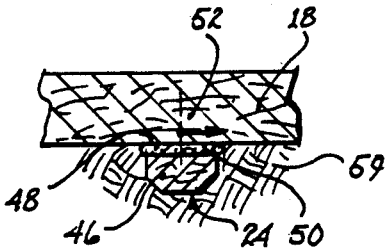
FIG. 5 is a section view taken along the line 5—5 of FIG. 4.

As shown in FIG. 2, sole 18 has, for example, ten cleats 24, 26, 28, 30, 32, 34, 36, 38, 40, 42. Some of the cleats such as, for example, 24, 26, 28, 30, 32, 38, 40 and 42 have a substantially rectangular configuration while the cleats such as, for example, 34 and 36 have a substantial cylindrical configuration. It should be understood that the invention is applicable to cleats of any desired configuration. Sole 18 also has a lower surface 44 to which the ten cleats are attached. Typical cleat 24, which is substantially identical (other than the configuration thereof) to the other nine cleats 26, 28, 30, 32, 34, 36, 38, 40, 42, has a bottom face 46 and a top face 48 (see FIG. 4). The top face 48 has an adhesive layer 50, which is bonded thereto. Adhesive layer 50 is also bonded to a portion of the lower surface 44 of the sole 18 which is designated by sole portion 52. Sole 18, heel 20, upper portion 12, top portion 22, cleat 24, and the other nine cleats 26, 28, 30, 32, 34, 38, 40, 42, are preferably composed of a leather and/or plastic type material.

In use, a twisting of the leg of a football player, or wearer, causes an applied torque 54 about an axis 56 (see FIG. 1). Applied torque 54 (see FIG. 1) causes a diagonal shear force on portion 52 (see FIG. 4) which is transmitted to cleat 24 (see FIG. 2) and the transmitted to the ground 59 (see FIG. 1).

The ground is assumed to be muddy, or relatively soft, so that the cleat 24 is sunken therein. Most of the other nine cleats receive respective shear forces, like shear force 58 (see FIG. 3), but of different value, due to differences in distances from area 56 (see FIG. 2), and other reasons.

Figure 3:
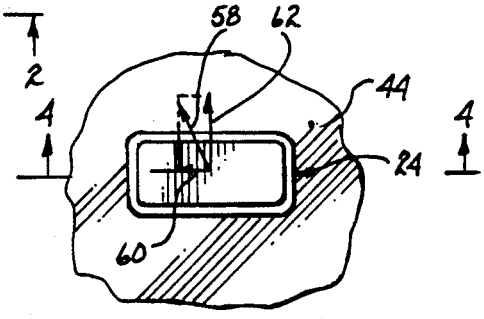
FIG. 3 is an enlarged view of a portion of FIG. 2.

Diagonal shear force 58 has an X-component 60, and a Y-component 62, as shown in FIG. 3. Diagonal shear 58, which is disposed normal to a radial line from axis 56 (see FIG. 2), causes a shear stress in adhesive layer 50. Adhesive layer 50 has a preselected failure stress level, which permits a separation of cleat 24 from sole 18 when the shear force on the cleat 24 (from turning the shoe because of, for example, impact from another player, etc.) exceeds the preselected failure stress level.

Figure 6A:
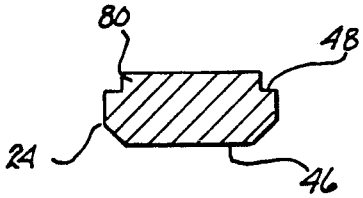
FIG. 6*a* is a side view of an alternative embodiment of the cleat shown in FIG. 4.
Figure 6B:
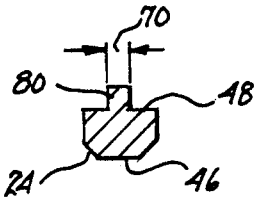
FIG. 6*b* is a front view of the alternative embodiment of FIG. 6*a*.

As an alternative embodiment to the use of the adhesive layer 50, the cleat 24 can have a neck portion 80 (such as part of a screw or attachment type mechanism for insertion into a corresponding hole in the sole 18, as shown in FIG. 6*a* and 6*b*). The thickness 70 of the neck portion 80 is preselected so as to break upon exposure to a certain diagonal force 58.

Cleat 24 is a break-away cleat, and separates from sole 18 at a preselected value of diagonal shear force 58, when the applied force is such as to cause adhesive layer 50 to fail to maintain attachment of the cleat 24 to the sole 18. The same situation applies to the embodiment of FIGS. 6*a* and 6*b*. Corresponding shear forces on some of the other nine cleats cause similar separation of such cleats from the sole 18.

Many leg injuries, such as injuries to the knee and ankle, can now be avoided by the use of shoe 10. The breaking away of some or all of the ten cleats permits a natural turning of shoe 10 by applied torque 54, thus avoiding a leg injury.

While the invention has been described in its preferred embodiments, it is to be understood that the words which have been used are words of description rather than limitation and that changes may be made within the purview of the appended claims without departing from the true scope and spirit of the invention in its broader aspects. For example, cleats 24, 26, 28, 32, 36, 38, 40, 42 and sole 18 can be composed of a rubber material, or rubber - like material.

I claim: The embodiment of an invention in which an exclusive property or right is claimed are defined as follows:

1. An athletic shoe comprising:

a vertical portion for enclosing a portion of a person's foot;

a sole located on the bottom portion of said shoe; and a plurality of cleats fixedlyconnected to a flat lower sruface of said sole;

each cleat having a bottom portion and a top portion; and means connected to each sleat top portn and to an adjacent portion of the sole lower surface having a preselected level of shear failure stress for causing eachcleat to break-away from said sole when the shear failure stress corresponding to at least the preselected shear force is applied at an angle to said cleat, the entire portion of each cleat being below the flat lower surfaace of said sole.

2. The shoe of claim 1 wherein said means is an adhesive layer connected to both each cleat top portion and to the adjacent portion of the sole lower surface.

3. The shoe of claim 1 wherein the vertical portion, the sole and the cleats are composed of a leather material.

4. The shoe of claim 1 wherein the sole and the cleats are composed of a rubber-like material.

5. An athletic shoe comprising:

a vertical portion for enclosing a portion of a person's foot;

a sole located on the bottom portion of said shoe; and a plurality of cleats fixedly connected to a flat lower surface of said sole;

each cleat having a bottom portion and a top portion; and means connected to each cleat top portion and to an adjacent portion of the sole lowr surface having a preselected level of shear failure stress for causign each cleat to break-away from saaid sole when the shear falure stress corresponding to at least the preselected shear force is applied at an agle of said cleat; said means is a break-away portion of said cleat attached to both said cleat top portion and to the adjacent portion of the sole lower surface.

6. The shoe of claim 5 wherein said break-away portion is narrower than at least one of the width and length of the cleat's top portion.

7. A method, for reducing injuries caused by an athletic shoe having a plurality of cleats, comprising the steps of:

providing an athletic shoe having a sole;

providing a pluraliaty of cleats attached to a flat bottom of the sole of said shoe, the entire portoin of each cleat being below the flat bottom of said sole; and providing break-away means between the top portion of each of said cleats and an adjacent flat bottom portion of said sole having a preselected level of shear failure stress for causing each cleat to break-away from the sole when subjected to at least the preselected shear force applied at an angle to said cleat.

8. The method of claim 7 wherein each break-away means is an adhesive layer attaching each of said cleats to said sole.

9. A method for reducing injuries caused by an athletic shoe having a plurality of cleats comprising the steps of:

providing an athletic shoe having a sole;

providing a plurality of cleats attached to a flat bottom of the sole of said shoe; and providing break-away means between the top portion of each of said cleats and an adjacent flat bottom portion of said sole having a preselected level of shear failure stress of causing each cleat to break-away from the sole when subject to at least the preselected shear force applied at an angle of said cleat, said break-away means is a break-away portion attached to each of said cleats and to said sole.

10. The method of claim 9 wherein said break-away portion is narrower than at least one of the width and length of the top portion of each of said cleats adjacent to said sole.

* * * * *